United States Patent [19]

Herdeg et al.

[11] Patent Number: 4,512,271

[45] Date of Patent: Apr. 23, 1985

[54] PATTERN SELECTION SYSTEM

[75] Inventors: Donald F. Herdeg, South Hamilton; William G. Matseas, Rowley, both of Mass.

[73] Assignee: USM Corporation, Farmington, Conn.

[21] Appl. No.: 434,037

[22] Filed: Oct. 20, 1982

[51] Int. Cl.[3] ..... D05B 3/02; D05B 21/00

[52] U.S. Cl. ..... 112/158 E; 112/158 F; 112/121.12

[58] Field of Search ..... 112/158 E, 158 F, 121.11, 112/121.12

[56] References Cited

U.S. PATENT DOCUMENTS

| | | | |
|---|---|---|---|
| 4,177,744 | 12/1979 | Wurst et al. | 112/158 E |
| 4,275,674 | 6/1981 | Carbonato et al. | 112/158 E |
| 4,323,022 | 4/1982 | Hanyu et al. | 112/158 E |
| 4,334,486 | 6/1982 | Toshiaki et al. | 112/158 E |
| 4,335,667 | 6/1982 | Beckerman et al. | 112/158 E |
| 4,341,169 | 7/1982 | Mainot et al. | 112/121.12 |
| 4,341,170 | 7/1982 | Beckerman et al. | 112/158 E |

*Primary Examiner*—Peter Nerbun

*Attorney, Agent, or Firm*—William F. White

[57] ABSTRACT

A pattern selection system having a relatively small number of pattern selection switches is disclosed. Each pattern selection switch is assigned a particular stitch pattern that is stored in a memory. The assigning of the stitch patterns occurs in a series of communications between the operator and the pattern selection system. These communications include the displaying of the stitch pattern assignment that is being made. The pattern selection system thereafter displays the stitch pattern assignment each time the pattern selection switch is activated.

14 Claims, 10 Drawing Figures

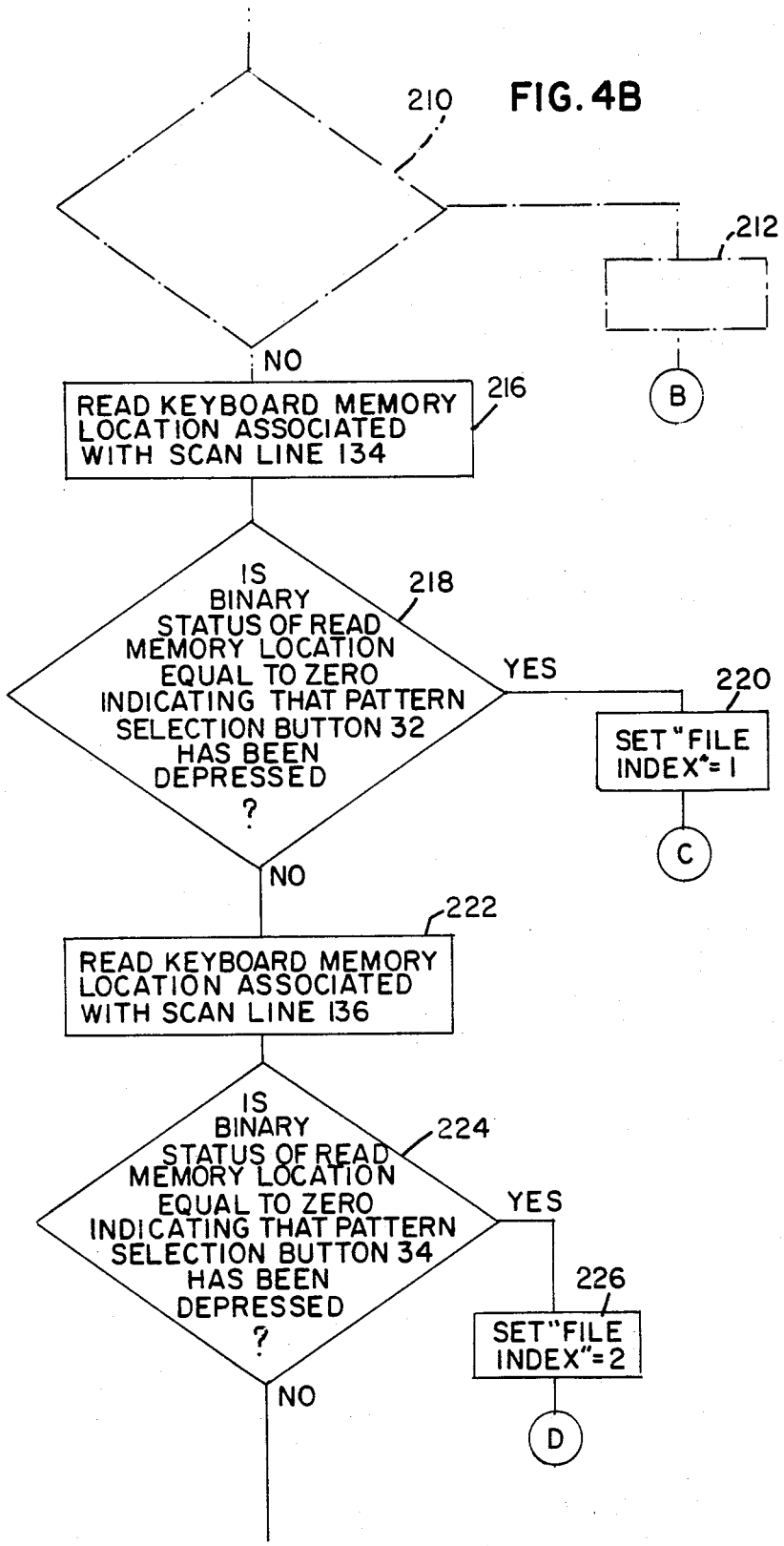
FIG. 4B
210
212
B
NO
READ KEYBOARD MEMORY LOCATION ASSOCIATED WITH SCAN LINE 134
216
IS BINARY STATUS OF READ MEMORY LOCATION EQUAL TO ZERO INDICATING THAT PATTERN SELECTION BUTTON 32 HAS BEEN DEPRESSED ?
218
YES
220
SET "FILE INDEX"=1
C
NO
222
READ KEYBOARD MEMORY LOCATION ASSOCIATED WITH SCAN LINE 136
IS BINARY STATUS OF READ MEMORY LOCATION EQUAL TO ZERO INDICATING THAT PATTERN SELECTION BUTTON 34 HAS BEEN DEPRESSED ?
224
YES
226
SET "FILE INDEX"=2
D
NO

PATTERN SELECTION SYSTEM

FIELD OF THE INVENTION

This invention relates to the automatic sewing of predefined stitch patterns within an automatic sewing machine system. In particular, this invention relates to an automatic selection of the predefined stitch patterns that are to be sewn within an automatic sewing machine.

BACKGROUND OF THE INVENTION

The manner in which a stitch pattern is selected within an automatic sewing machine has become increasingly more important in the field of automated sewing. The operator of an automatic sewing machine must quickly and efficiently select the appropriate stitch pattern that is to be sewn in order to achieve a high volume of sewing. This has led to various approaches as to how to communicate the selected pattern to the sewing machine. One approach has been to provide an array of pattern selection buttons or switches on a control panel associated with the sewing machine. Each pattern selection button is associated with a stored stitch pattern residing in an electronic memory that is to be called forth for execution by the sewing machine. This approach works well for a limited number of stitch patterns requiring a relatively small number of pattern selection buttons. It is to be appreciated that this approach becomes less attractive as the number of stitch patterns to be selected becomes relatively high. It is furthermore to be appreciated that even a few stitch patterns will require an appreciable control panel to accommodate the pattern selection buttons. It is still furthermore to be appreciated that the increasing number of pattern selection buttons increases the likelihood of operator confusion and the possibility of pressing the wrong button.

OBJECTS OF THE INVENTION

It is therefore an object of this invention to provide a pattern selection system within an automatic sewing machine that allows the operator to efficiently select a stitch pattern to be sewn.

It is another object of this invention to provide a pattern selection system within an automatic sewing machine that allows an operator to select from a relatively large number of stitch patterns in such a manner as to minimize any confusion to the operator.

SUMMARY OF THE INVENTION

The above and other objects are achieved according to the present invention by providing a pattern selection system having a relatively small number of pattern selection switches. Each pattern selection switch may be assigned a particular stitch pattern that is stored in memory. The assigning of the stitch patterns occurs in a series of communications between the operator and the pattern selection system. These communications include the displaying of the stitch pattern assignment to the operator as it is being made. The pattern selection system thereafter displays the stitch pattern assignment each time the pattern selection switch is activated.

BRIEF DESCRIPTION OF THE DRAWINGS

The above and other features of the invention will now be particularly described with reference to the accompanying drawings in which:

FIGS. 4A–4F are a flow chart illustrating the flow of computer commands within the pattern selection system so as to facilitate the selection of a pattern.

DESCRIPTION OF THE PREFERRED EMBODIMENT

Figure 1:
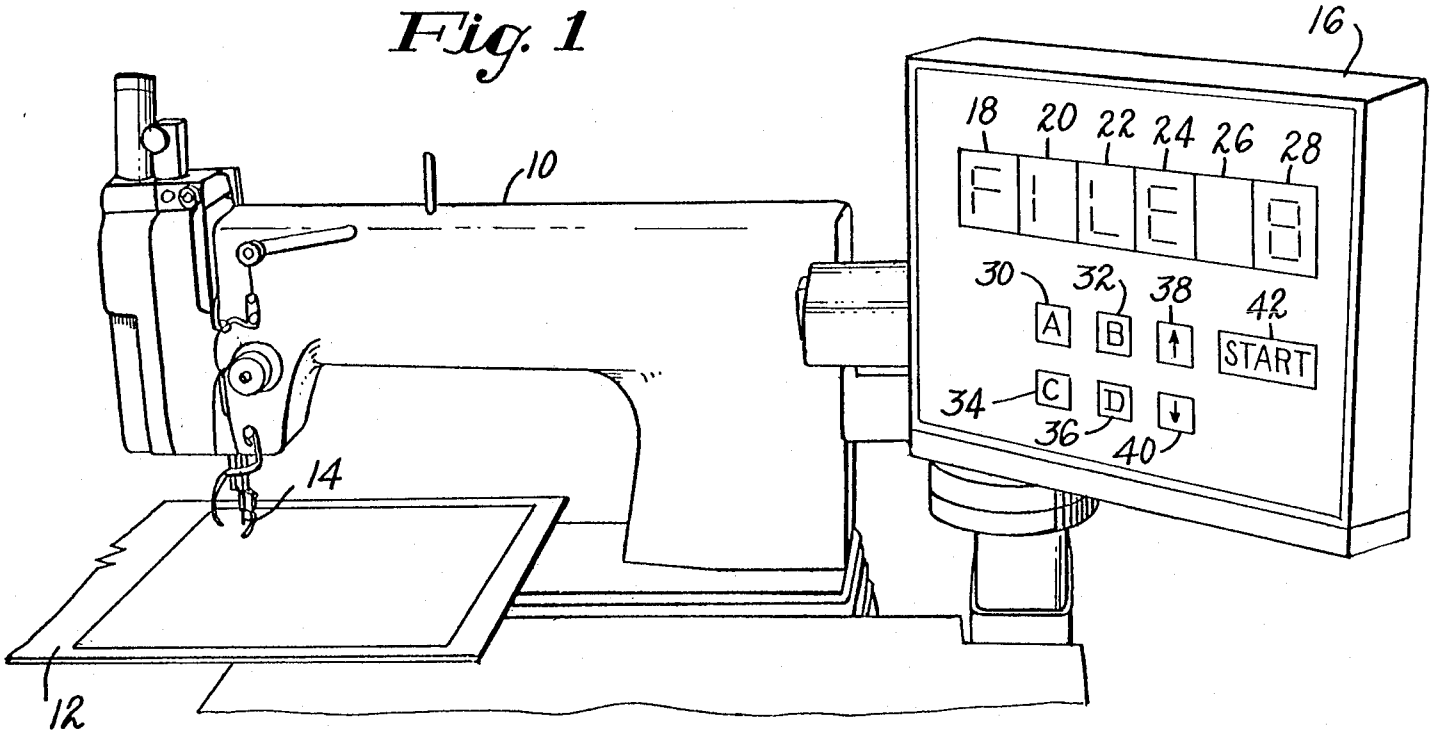
FIG. 1 is an overall view of an automatic sewing machine having a pattern selection panel.

Referring to FIG. 1, an automatic sewing machine 10 having a moveable workpiece support piece 12 is generally illustrated. The workpiece support 12 is positioned relative to a needle 14 of the automatic sewing machine 10 by positioning apparatus which is not shown. The positioning apparatus is responsive to a predefined pattern of movement usually stored within an electronic memory. This predefined pattern of movement includes positioning information for the workpiece support 12 as well as commands for the reciprocating needle 14. It is to be appreciated that such predefined patterns of movement stored in electronic memory are well known in the art.

A particular predefined pattern of movement for the workpiece support 12 is communicated to the automatic sewing machine 10 via a pattern selection panel 16. The pattern selection panel 16 includes a display portion having six individual alpha numeric displays 18, 20, 22, 24, 26, and 28. The pattern selection panel 16 furthermore includes four pattern selection buttons 30, 32, 34, and 36. Each of these pattern selection buttons preferably bears an alphabetic label such as A, B, C and D as shown. The pattern selection panel 16 furthermore includes a pair of directional selection buttons 38 and 40 which preferably have upward and downward arrows as shown. As will be explained in detail hereinafter, the directional selection buttons 38 and 40 are operative to change a stitch pattern number displayed on the alpha numeric displays 18 through 28. This change of the displayed stitch pattern number is always associated with one of the pattern selection buttons 30 through 36. In this manner, a particular stitch pattern number can always be associated with a particular pattern selection button. The particularly displayed stitch pattern can be thereafter selected by depressing the particular pattern selection button. The operator can always visually confirm that the appropriate stitch pattern has been selected prior to pressing a "start" button 42.

Figure 2:
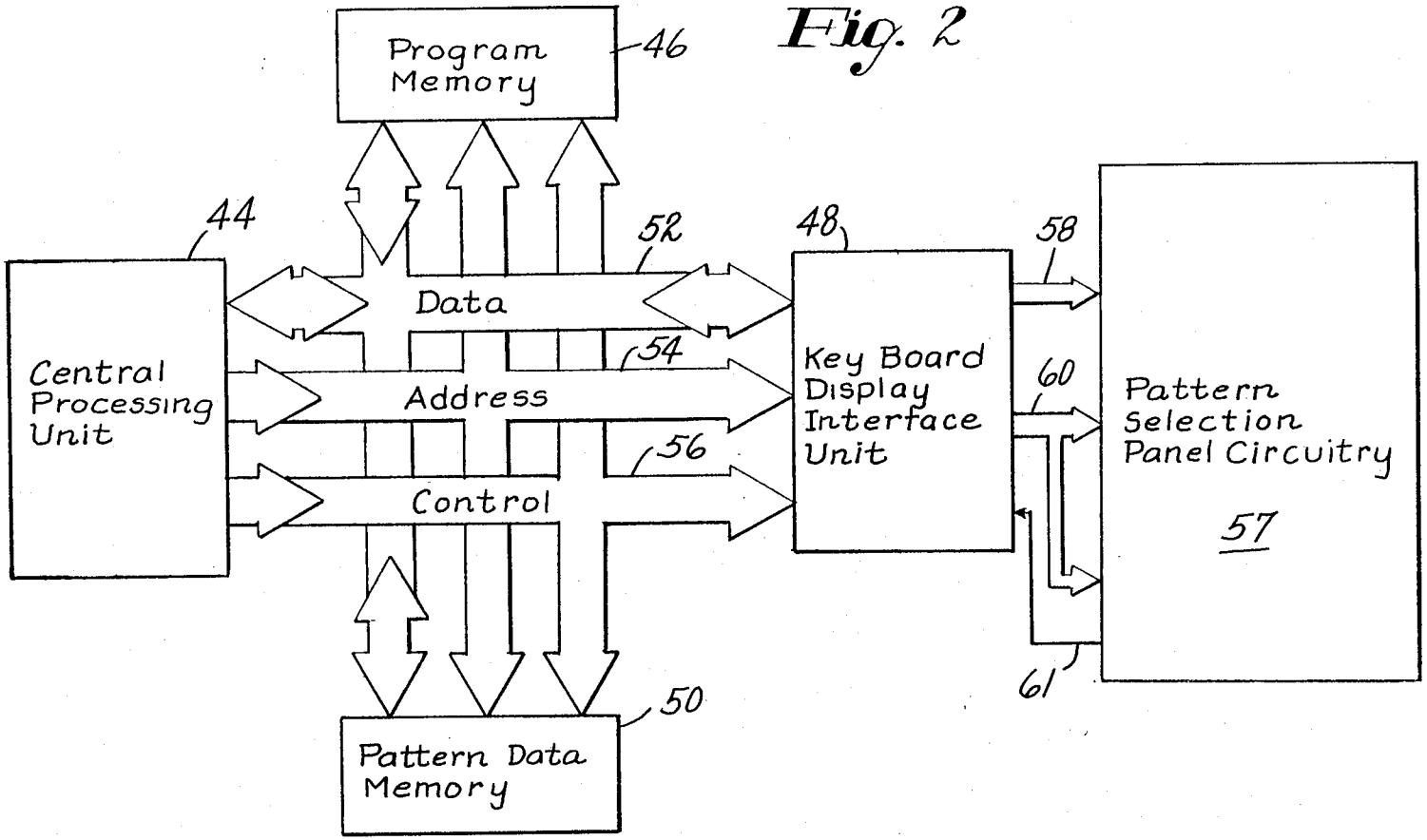
FIG. 2 is a block diagram of the pattern selection system which interfaces with the pattern selection panel.

Referring to FIG. 2, a pattern selection system which interfaces with the pattern selection panel 16 is generally illustrated. The pattern selection system is seen to include a central processor unit 44 which communicates with a program memory 46, a keyboard/display interface unit 48 and a pattern data memory unit 50 via a data bus 52, an address bus 54, and a data control bus 56. The central processor unit is preferably an INTEL 8085 microprocessor utilizing the INTEL Multibus structure so as to communicate with compatible eight bit units. In this regard, the keyboard/display interface unit 48 is preferably the INTEL 8279 keyboard/display interface. It is to be appreciated that the memory units 46 and 50 as well as the keyboard display interface 48 are addressed via the address bus 54, controlled by control signals appearing on the control bus 56 so as to either transmit or receive data via the data bus 52.

Referring to the keyboard/display interface unit 48, it is seen that this unit communicates with pattern selection circuitry 57 associated with the panel 16. In this regard, the keyboard/display unit 48 is operative to communicate with the display circuit portion of the pattern selection panel 16 via a bus 58. On the other hand, the keyboard/display unit 48 is operative to communicate with the various button switches on the pattern selection panel 16 via a bus 60. As will be explained in detail hereinafter, the keyboard/display interface unit 48 provides display information over the bus 58 which results in a display of alpha numeric characters on the alpha numeric displays 18 through 28. The keyboard-/display interface 48 also monitors the status of the pattern selection buttons 30 through 36 as well as the directional pattern selection buttons 38 and 40 and the "start" button 42. The status of each button switch on the pattern selection panel 16 is queried via the bus 60. The status of a given switch is relayed back to the interface unit via a common line 61.

Figure 3:
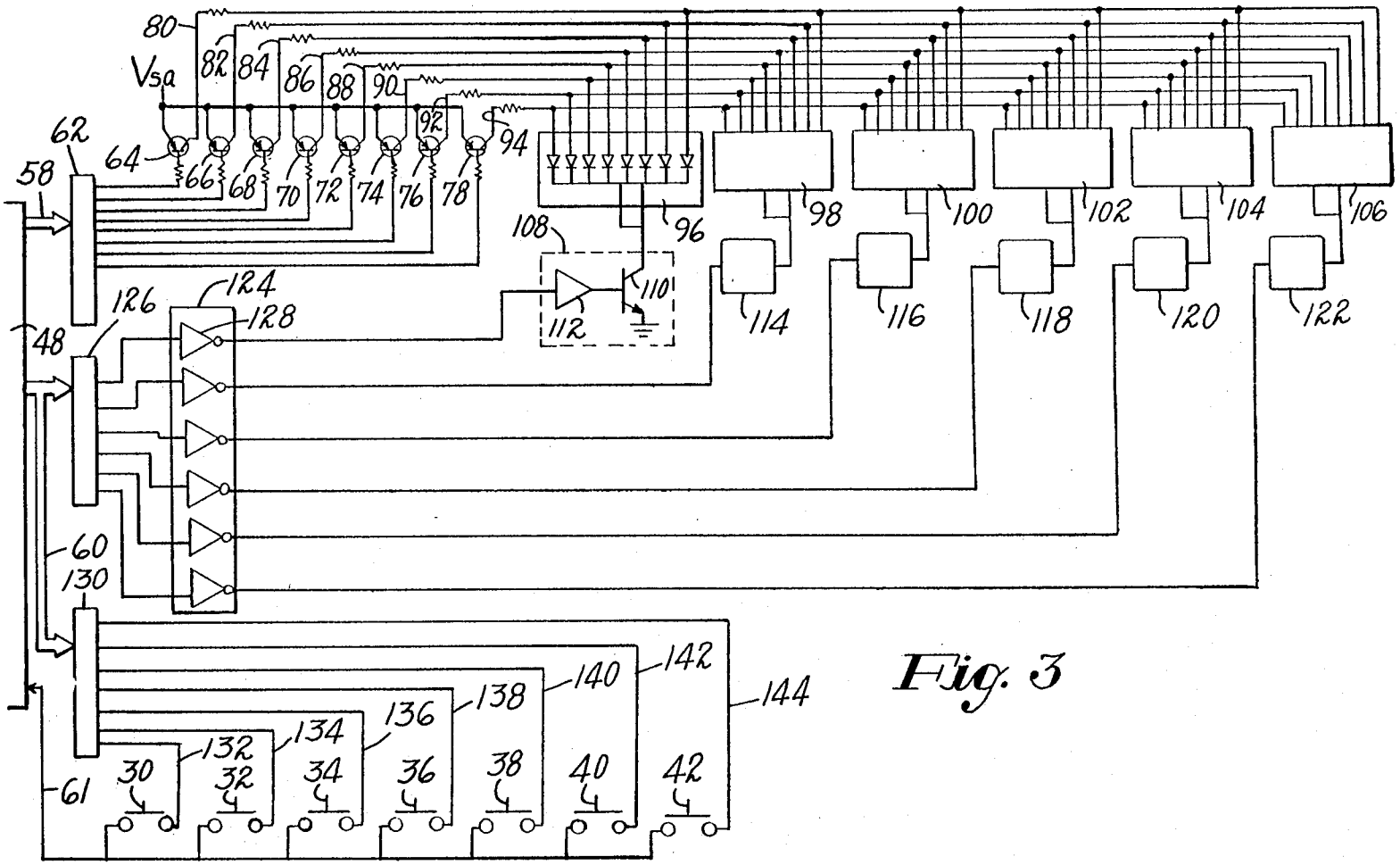
FIG. 3 illustrates circuitry within the pattern selection system.

Referring now to FIG. 3, the electrical circuitry 57 within the pattern selection panel 16 is illustrated in detail. In particular, the electrical circuitry is illustrated in association with the buses 58 and 60 from the keyboard/display interface unit 48. In accordance with the invention, the bus 58 carries eight bits of character generation code for a seven segmented character display. These coded bits from the keyboard/display interface unit 48 are applied to an octal buffer circuit 62 which provides an appropriate current interface to the base inputs of eight separate drive transistors 64, 66, 68, 70, 72, 74, 76 and 78. The octal buffer circuit is preferably a 74 LS244 chip available from various semi-conductor manufacturers. This octal buffer circuit is capable of handling the base current of the drive transistors 64 through 78. The emitter of each of the drive transistors 64 through 78 is connected to a common voltage supply source $V_s$ which is preferably $\pm 5$ volts. The collectors of the drive transistors 64 through 78 are connected to current drive lines 80, 82, 84, 86, 88, 90, 92, and 94. A current is produced on a respective current drive line when the drive transistor associated therewith becomes conductive by virtue of the bias voltage dropping low at its respective base terminal. This occurs when the respective output of the octal buffer circuit 62 associated with the base input drops logically low.

Each current drive line is individually tapped by one of six character display circuits 96, 98, 100, 102, 104 and 106. Each character display circuit comprises eight light emitting diodes each of which is connected to a respective current drive line. This diode circuit is illustrated for the character display circuit 96. Each of the light emitting diodes is commonly connected to an output circuit such as 108 for the character display circuits 96. The output circuit 108 is seen to comprise a grounded transistor 110 having an amplifier 112 connected to its base terminal. It is to be appreciated that each of the character display circuits has an output circuit such as 114, 116, 118, 120 and 122 associated therewith. The input to the amplifier within each output circuit is a logic level voltage which has been inverted by an inverting amplifier associated therewith. These inverting amplifiers are illustrated within a hex inverter circuit 124. Each inverting amplifier within the hex inverter circuit 124 receives a logic level voltage signal from a line decoder circuit 126. The line decoder circuit 126 receives three coded bits from the bus 60 which define in binary the identity of each of the character display circuits. The identity of a given character display circuit is decoded by the line decoder circuit 126 so as to produce a logically low or binary zero signal at the output of the line decoder circuit associated with the particular character display circuit. For example, the character display circuit 96 would be identified by three binary zero bits appearing on the respective bit lines within the bus 60. This would be decoded by the line decoder circuit 126 so as to produce a logically low signal only on the output line associated with an inverting amplifier 128 within the inverter circuit 124. The logically low voltage level would be inverted by the amplifier 128 so as to produce a logically high voltage signal applied to the amplifier 112 which in turn causes the grounded transistor 110 to become conductive. In this manner, the light emitting diodes within the character display circuit 96 become conductive in response to any current appearing on a current drive line associated therewith. The current drive lines 80 through 94 will be individually providing drive currents to respective light emitting diodes within the character display circuit 96 in response to a character generation code. The character generation code originates from a display memory within the keyboard/display interface unit 48 and is forwarded to the octal buffer circuit 62 via the bus 58. The amplifiers within the octal buffer circuit will drop logically low in accordance with the character generation code so as to allow the corresponding drive transistors to become conductive. It is to be appreciated that the character generation code is a standard seven segmented display code wherein individual line segments within a Figure "8" may be individually illuminated so as to thereby define alpha numeric characters. Referring to FIG. 1, it is seen that the alpha numeric display 28 has the numeral "8" displayed thereon. This would require the seven individual segments comprising the character "8" to be illuminated. This is accomplished by causing the seven corresponding light emitting diodes in the character display circuit 106 to become conductive. It is to be noted that the eighth light emitting diode is that of a decimal point which is not shown in any of the alpha numeric displays of FIG. 1. It is to be appreciated that each of the illustrated alpha numeric displays, 18, 20, 22, 24 and 26 in FIG. 1 are also responsive to the character display circuit associated therewith. In this regard, the character display circuit 96 is associated with the alpha numeric display 18 whereas the character display circuit 98 is associated with the alpha numeric display 20, the character display circuit 100 is associated with the alpha numeric display 22, the character display circuit 102 is associated with the alpha numeric display 24 and the character display circuit 104 is associated with the alpha numeric display 26. It is furthermore to be appreciated that an eight bit character generation code for each display circuit resides within the display memory in the keyboard/display interface unit 48. This character generation code is forwarded over the bus 58 in conjunction with a three bit identification of the particular display circuit via the bus 60. In this manner, the keyboard/display interface unit 48 continually maintains the display portion of the pattern selection panel 16.

Having now discussed the manner in which the keyboard/display interface unit controls the display portion of the pattern selection panel 16, it is now appropriate to turn to the monitoring of the various button switches present on the pattern selection panel 16 by the same unit. In this regard, it will be remembered that the pattern selection panel preferably includes four pattern selection buttons, two directional pattern selection buttons, and one "start" button. The status of each button switch appearing on the pattern selection panel 16 is monitored as follows. The keyboard/display interface unit 48 is operative to identify each button switch by a particular three bit binary code appearing on the bus 60. This three bit binary code is applied to a line decoder 130 which responds by producing a logically low signal on one of the seven output scan lines associated therewith. These output scan lines are labelled 132, 134, 136, 138, 140, 142 and 144. Each of these output scan lines is connected to a terminal of one of the button switches 30 through 42. The other terminal of each button switch is connected to the common line 61. The common line 61 is connected to the return line input terminal of the programmable keyboard/display interface unit 48. In the preferred embodiment, the keyboard/display interface unit is an INTEL 8279 which possesses such a return line input.

The keyboard/display interface unit 48 is operative to monitor this return line input in conjunction with the identification of each of the individual button switches 30 through 42. In this regard, the keyboard/display interface unit sequentially identifies each of the button switches via the bus 60 so as to cause each output scan line 132 through 144 to sequentially drop logically low. In the event that a particular switch has been depressed, current will flow from the return line input terminal through the common line 61 when the scan line associated with the depressed switch drops logically low. This current flow will be noted by the keyboard/display interface unit which will store a binary zero in the keyboard memory location associated with that output scan line. On the other hand, if the switch associated with an energized scan line is open, then the keyboard memory location associated with that output scan line will remain equal to binary one.

Having now described the pattern selection system, it is appropriate to turn to the overall control of this system by the central processor unit 44. Referring to FIGS. 4A through 4F, a flow chart illustrating the operation of the central processor unit 44 within the pattern selection system is illustrated. It is to be appreciated that this flow chart is illustrative of a computer program resident within the program memory 46. In this regard, the instructions within the program memory 46 are sequentially read from program memory 46 via the data bus 52 so as to allow the central processor unit 44 to execute each instruction thus received. As will become apparent hereinafter, the central processor will typically be communicating with the keyboard/display interface unit 48 so as to control the selection of a pattern and the display of a numerical designation for a previously selected pattern before the stitch pattern is run on the automatic sewing machine. The actual execution of the stitch pattern will thereafter take place when the central processor unit 44 accesses the stored pattern data resident within the pattern data memory 50. It is to be noted that this accessing of the actual pattern data and implementing the sewing pattern is well known in the art of automatic sewing.

Figure 4A:
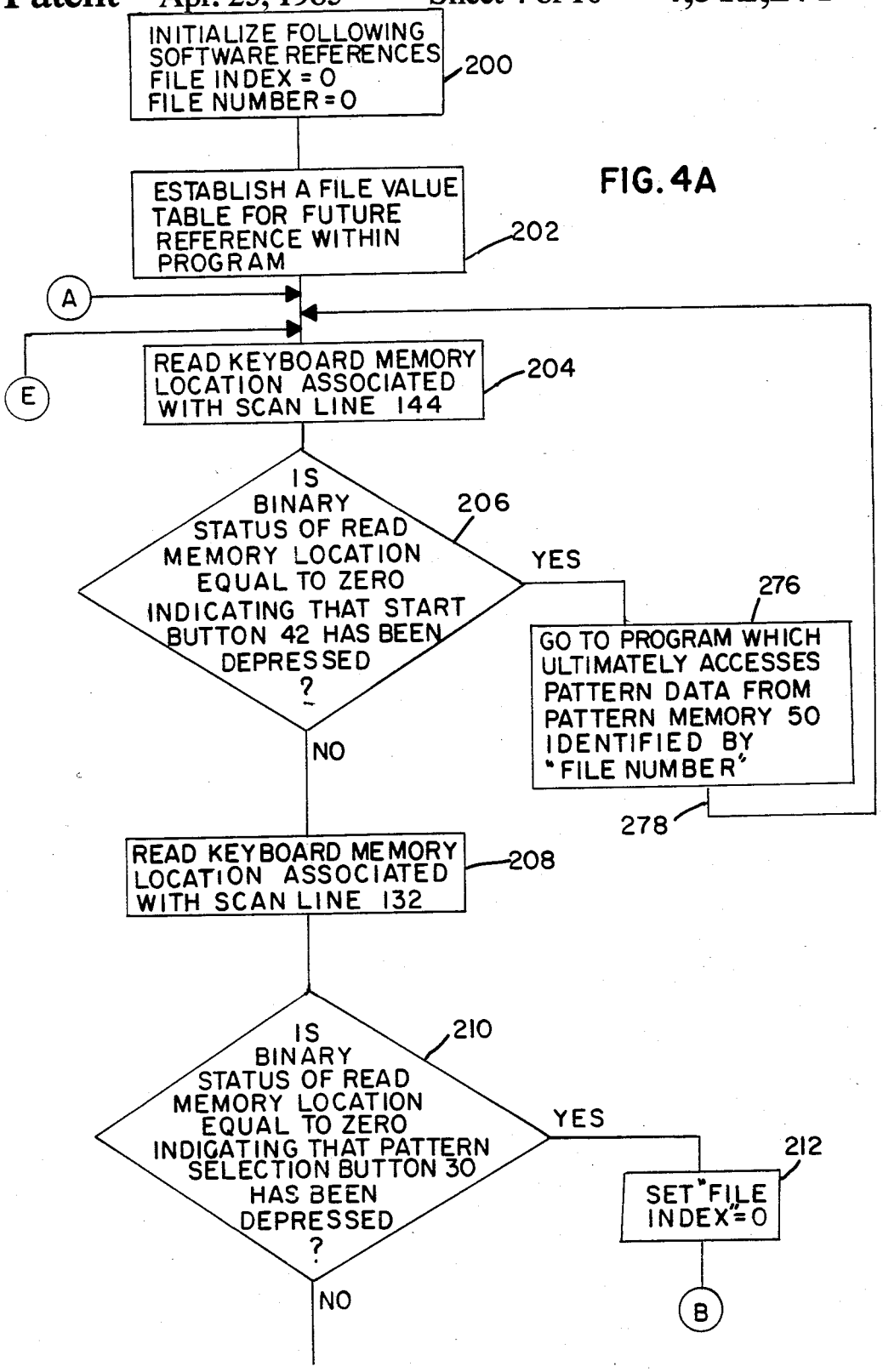
Figure 5:
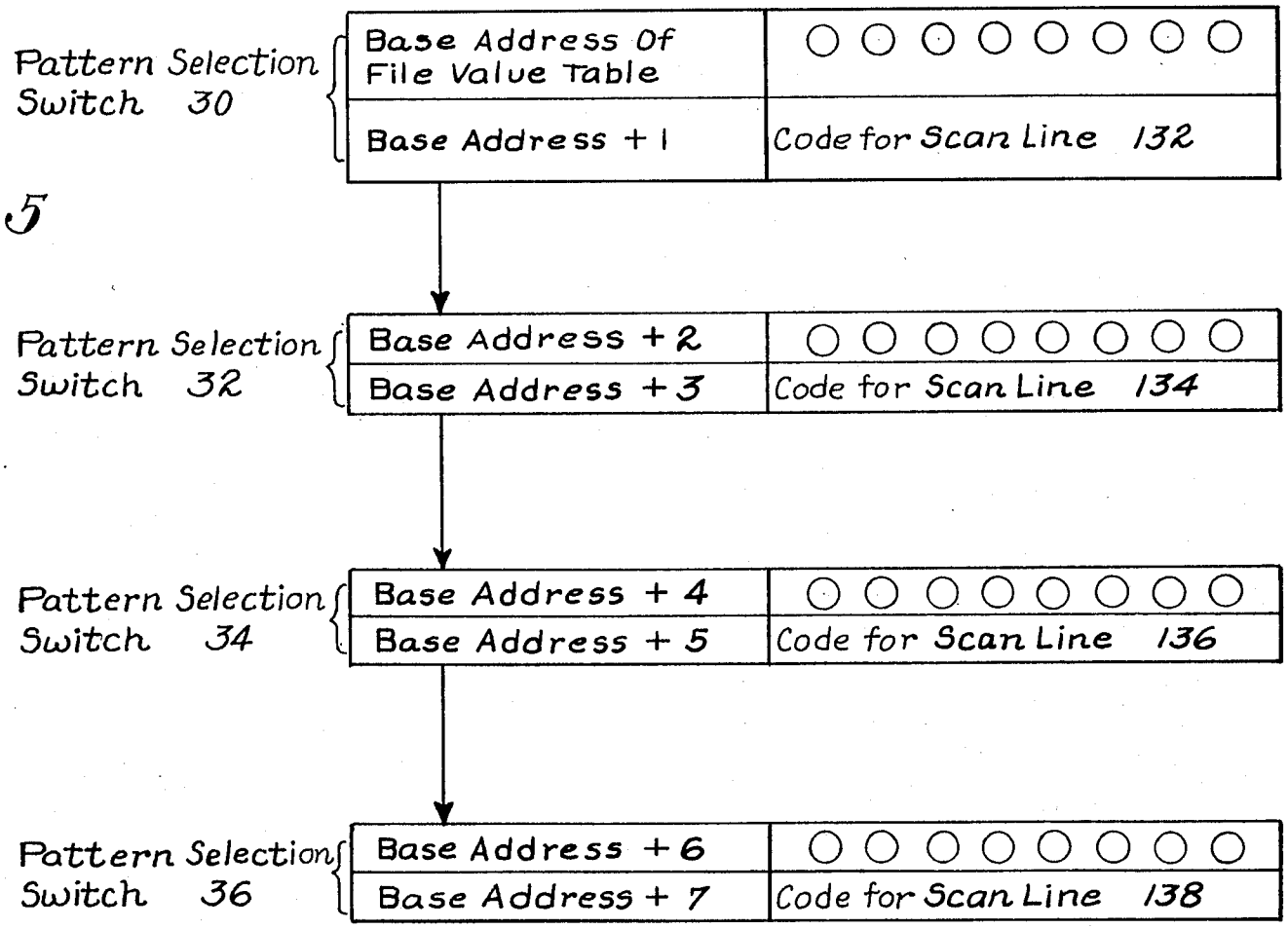
FIG. 5 illustrates a table of values utilized within the flow chart of FIG. 4.

Referring to FIG. 4A, the program begins with a step 200 wherein certain software references used within the program are initialized to zero. The central processor unit next proceeds to a step 202 wherein a "file value" table is established. Referring to FIG. 5, the "file value" table is particularly illustrated. The "file value" table is preferably located within a portion of the program memory 46 occupying eight separate storage locations which are separately addressable. In this regard, the first storage location is addressed by noting the base address of the "file value" table. The seven remaining storage locations are each separately addressable by adding the appropriate numerical value to the base address of the "file value" table.

It is to be noted that the "file value" table is broken into two separately addressable storage locations for each pattern selection switch. In this regard, the first storage location in each grouping is initially all zeroes. The second storage location in each grouping is denoted as containing the binary code for the particular scan line associated with the pattern selection switch. This is the binary code which identifies a particular storage location within the keyboard memory of the keyboard/display interface unit 48. In this regard, it will be remembered that the keyboard/display interface unit monitors the status of each switch and stores the binary status thereof in a keyboard memory location. The address of these respective keyboard memory locations is the same as the binary code utilized to identify the scan lines. In this regard, the three bit binary code for scan line 132 is preferably "000", whereas the three bit binary code for the scan line 144 is "110". The binary status for the pattern selection switch 30 would hence appear in a storage location within the keyboard memory having an address of "000". By the same token, the binary status for the "start" switch 42 would appear in a storage location within the keyboard memory having an address of "110".

Figure 4C:
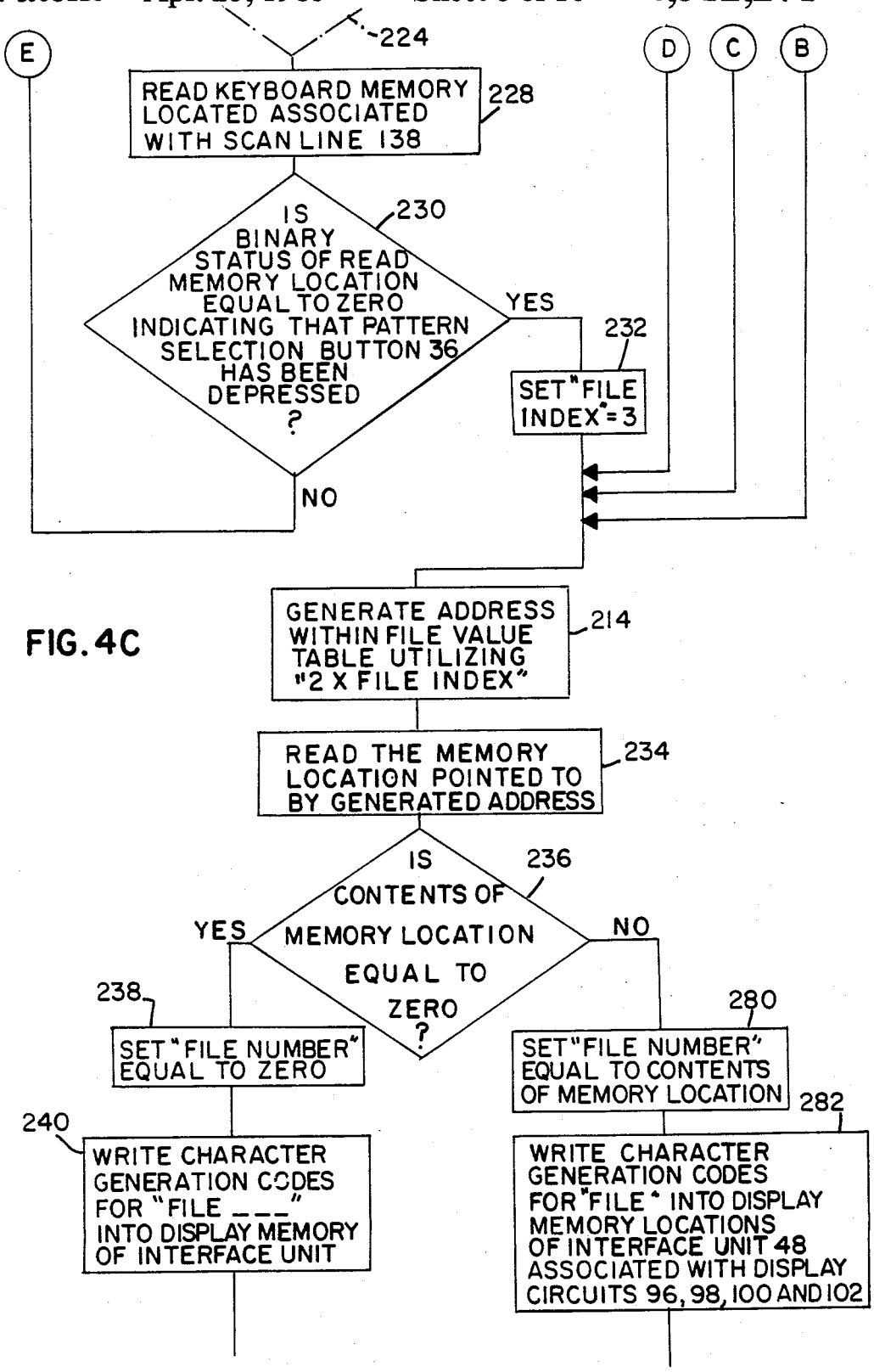
Figure 4D:
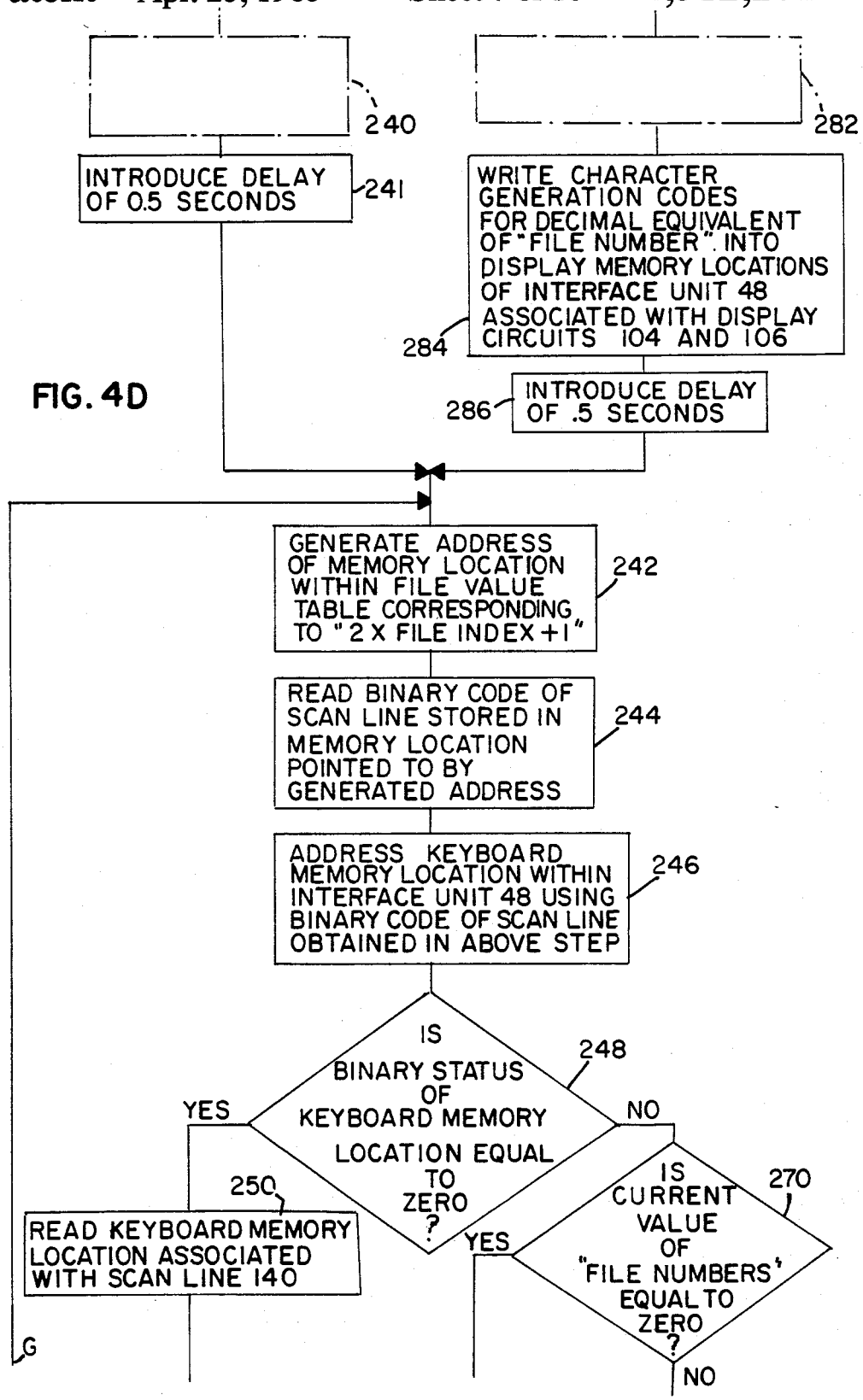

Referring to FIG. 4A, the central processor now proceeds to a step 204 wherein the keyboard memory location associated with the scan line 144 is read. It will be remembered that the keyboard memory location associated with the scan line 144 will have a three bit address of "110". This address is provided to the keyboard/display interface unit 48 via the address bus 54 in conjunction with a read control signal for the keyboard memory via the control bus 56. The information stored within the thus addressed keyboard memory location will be provided to the central processor 44 via the data bus 52. It will be remembered that the keyboard/display interface unit 48 continually monitors the status of each button switch on the pattern selection panel 16. In this regard, the keyboard memory location associated with the scan line 144 will only be zero when the "start" button 42 has been depressed. Accordingly, the central processor asks in a step 206 whether the binary status of the memory location read in step 204 is equal to zero. In the event that the "start" button has not been depressed, the central processor unit proceeds along a "NO" path to a step 208 wherein the keyboard memory location associated with the scan line 132 is read. This keyboard memory location will have a keyboard memory address of "000" which is addressed and read in much the same manner as has been previously described with respect to the reading of the keyboard memory location in step 204. The central processor next asks in a step 210 as to whether the binary status of the thus read memory location equals zero. In this regard, it will be remembered that a binary status of zero is an indication that the pattern selection button 30 has been depressed. In the event that this has occurred, the central processor proceeds along a "YES" path to a step 212 wherein the software reference "file index" is set equal to zero. The central processor now proceeds to a step 214 in FIG. 4C. In this regard, it is to be noted that the path from step 212 to step 214 in FIG. 4C is connected by the common junction labelled B. This practice occurs throughout FIGS. 4A–4F wherein paths are to be joined between the figures. Step 214 calls for the generation of an address within the "file value" table utilizing twice the software reference "file index". This is done by adding the base address of the "file value" table in FIG. 5 to twice the numerical value of the software reference "file index". In this instance the numerical value of "file index" is zero by virtue of step 212, this will mean generating an address equal to the base address of the "file value" table.

It is to be appreciated that the "file index" may also have been set equal to certain other values upstream of step 214. In particular, if the pattern selection button 30 had not been depressed, the central processor would have proceeded along the "NO" path from the step 210 to a step 216. The central processor would have read the keyboard memory location associated with the scan line 134 and thereafter inquired as to whether or not the binary status of the thus read memory location was equal to zero in a step 218. It will be remembered that this memory location will contain the binary status of the pattern selection button 32. In the event that the pattern selection button 32 has been depressed, the binary status will be at zero causing the computer to proceed along a "YES" path to a step 220. The software reference "file index" will be set equal to one in step 220 before proceeding via common junction C to the step 214 in FIG. 4C. Referring again to step 218, it is to be noted that if the pattern selection button 32 has not been depressed, then the "NO" path will proceed to a set of steps 222 and 224 wherein the status of the pattern selection button 34 will be checked. In the event that button 34 has been pressed, the central processor will set the "file index" equal to two in a step 226 and proceed to step 214 via common junction D. On the other hand, if the pattern selection button 34 has not been depressed, the central processor will proceed along a "NO" path to a set of steps 228 and 230 wherein the status of the pattern selection button 36 will be checked. In the event that the pattern selection button 36 has been depressed, the "file index" will be set equal to three in a step 232 before proceeding to step 214. It is to be noted that if none of the pattern selection buttons have been depressed, the central processor will proceed along a "NO" path out of step 230 and return to step 204 via common junction E. The status of the various pattern selection buttons as well as the "start" button will again be checked following this return to step 204. Referring again to step 214, it is seen that the generated address will vary in accordance with the numerical value of the "file index". In particular, the multiplication of the "file index" by two before adding the base address of the file table thereto will result in a generated address equal to the base address plus 2, 4, or 6. Referring to FIG. 5, it is seen that the various generated addresses of step 214 identify the first storage location in each pair of storage locations associated with a pattern selection switch. The contents of each of these storage locations is initially zero. As will be described in detail hereinafter, these storage locations will ultimately contain an assigned numerical value for the particular pattern selection switch. Referring to step 234 in FIG. 4C, the central processor reads the particular memory location pointed to by the generated address of step 214. The central processor will thereafter in a step 236 inquire as to whether or not the contents of the memory location equals zero. This will initially be the case with respect to all such memory locations within the "file value" table of FIG. 5. The central processor will hence proceed along a "YES" path to a step 238. The central processor will set the software reference "file number" equal to zero and proceed to a step 240.

The central processor now proceeds to write character generation codes for the message "FILE——". These codes are written into the display memory of the keyboard/display interface unit 48. This is accomplished by addressing the display memory within the keyboard/display interface unit 48 and thereafter generating a "write" control signal on the control bus 56. The eight bits of data for each character to be displayed is forwarded to a specific location within the display memory. The specific location within the display memory will have a three bit address corresponding to the identification of the associated display circuit appearing on the bus 60. Each bit of data will define whether or not a light emitting diode in the display circuit associated with the memory location is to be activated. In this manner, the letter "F" will ultimately be generated by the display circuit 96 whereas the letter "I" will be generated by the display circuit 98, the letter "L" will be generated by the display circuit 100, the letter "E"0 will be generated by the display circuit 102 and the display circuits 120 and 122 will each generate a blank. It is to be appreciated that the operative control of each of the display circuits 96 through 106 is by the keyboard/display interface unit 48.

The thus displayed message appearing on the pattern selection panel 16 will alert the operator of the machine that a stitch pattern file has not been previously assigned to the depressed pattern selection button. The thus displayed message will be maintained for at least one half second by virtue of step 241. The central processor 44 will now await a communication from the operator as to the assignment of a numerical value identifying a stitch pattern file. Referring now to step 242, the central processor generates the address of the memory location within the "file value" table corresponding to "2× file index +1". Referring to FIG. 5, it will be seen that the base address of the "file value" table is added to the resulting sum of "2× file index +1" in order to address the second memory location associated with each pattern selection switch. These storage locations are seen to contain the binary code for the particular scan line associated with the designated switch. For instance, if the pattern selection switch 32 had been noted as being depressed in step 218, then the "file index" would be equal to 1. This would result in a numerical value of "3" being added to the base address of the "file value" table in step 242. This would result in an address for the memory location containing the binary code for the scan line 134. The central processor proceeds in a step 244 to read the binary code of the particular scan line stored in the memory location pointed to by the generated address. It will be remembered that the binary code for a particular scan line is also the address of the keyboard memory location within the interface unit 48 containing the binary status of the pattern selection button associated with the scan line. This keyboard memory location is addressed in a step 246. The binary status of the addressed keyboard memory location is checked in a step 248. If the binary status is equal to zero, the central processor unit pursues the "YES" path to a step 250. It is to be noted that the binary status of the keyboard memory location addressed in step 248 can only be zero if the pattern selection switch associated with the identified scan line remains depressed. This identified scan line must be the same scan line as was previously identified in steps 208 through 232.

Referring to step 250, it is seen that the central processor reads the keyboard memory location associated with scan line 140. It will be remembered that the scan line 140 is associated with the "up" button switch 38. The status of this switch is stored in a predetermined keyboard memory location which can be specifically addressed in step 250. Specifically, the address of the keyboard memory location is the same as the three bit binary code for the display circuit associated with the switch 38. The central processor inquires as to whether the contents of the read memory location are equal to zero in a step 252. If the "up" button has been depressed, the central processor proceeds along a "YES" path to a step 254 wherein the current value of the software reference "file number" is checked for being at its maximum. In this regard, the preferred embodiment of the invention arbitrarily has set a maximum of 32 stitch pattern files which may be selected. The central processor hence asks whether the current value of "file number" is less than this maximum number. If it is not, then the central processor proceeds along a "NO" path marked by the letter G back to step 42. Steps 242 through 248 will again keep monitoring the status of the particular pattern selection button that has been previously depressed. The central processor will continue to cycle and exit out of the "NO" path to the extent that a maximum file number condition exists. Referring now again to step 254, if the current value of the software reference "file number" is less than the maximum, then the central processor proceeds along the "YES" path to a step 256 wherein the current value of the software reference "file number" is increased by 1. It will be remembered that the software reference "file number" is initially zero and hence will first become one in step 256. The central processor now proceeds via common junction F to a step 258 of FIG. 4E wherein the character generation codes for the decimal equivalent of the current value of "file number" are written into display memory locations associated with display circuits 104 and 106. This will effectively change the displayed message appearing on the display portion of the pattern selection panel 16 from a blank reference to that of a "FILE 1". The central processor now proceeds to a step 260 wherein a half second delay is introduced allowing the operator time to react to the displayed message. The central processor next proceeds on a path marked by the letter G back to step 242 of FIG. 4D. The path G appears on FIGS. 4F, 4E and 4D and serves as a return path to step 242 from a number of different points within the program. It will be remembered that step 242 in conjunction with steps 244 and 246 is operative to consult the "file value" table and inquire as to whether or not the previously depressed pattern selection switch remains depressed. In the event that this particular pattern selection switch remains depressed, the central processor will again execute steps 250 through 258 wherein the current value of the file number is increased by one if the "up" switch 38 remains depressed.

Referring to step 252 again, it is to be noted that the central processor will proceed along a "NO" path if the "up" button has not been depressed. In other words, the central processor has noted that the operator of the machine does not wish to increase the numerical value of the displayed pattern file number. The central processor proceeds along the "NO" path from step 252 to a step 262. The central processor in step 262 reads the memory location associated with a scan line 142. It will be remembered that the scan line 142 is associated with the "down" button 40 so that the read keyboard memory location in step 262 contains the status of this button switch. This status is checked in a step 264 which notes a depressed condition of the "down" button 40 when the contents of the read memory location are equal to zero. In the event that the "down" button is not depressed, the central processor proceeds along a "NO" path to the line G which returns to step 242 in FIG. 4D. Referring again to step 264, in the event that the "down" button is depressed, the central processor proceeds along a "YES" path to a step 266 wherein the current value of the software reference "file number" is checked. In particular, the current value of the software reference is checked for being greater than one. In the event that the "file number" is not greater than one, the "NO" path is pursued out of step 266 and the central processor unit returns to step 242 via path G. The central processor will again check to see whether the previously depressed pattern selection switch remains so depressed in steps 244 and 246 as has been previously described.

Referring again to step 266, if the current value of the "file number" is greater than one, then the central processor proceeds along a "YES" path to a step 268 wherein the current value of the software reference "file number" is decreased by one. The central processor now proceeds to step 258 wherein the decimal equivalent of the current value for the software reference "file number" is written into the display memory locations associated with display circuits 104 and 106. The numerical value will hence be displayed on the display portion of the pattern selection panel for one half second as required by step 260. The central processor then proceeds to a step 242 and again checks as to whether or not the previously depressed pattern selection button remains so depressed in steps 244, 246 and 248.

Referring to step 248, it is to noted that when the pattern selection switch being monitored by steps 242 to 246 is no longer depressed, the binary status will change to a non zero state. This will cause the central processor to proceed along a "NO" path out of step 248 to a step 270. It is to be noted that at this juncture, the operator has elected to assign the displayed pattern file number to the previously depressed pattern selection button. This has occurred by virtue of releasing the depressed pattern selection button before the delay of step 260 has been completed. Referring now to step 270, the central processor inquires as to whether or not the current value of the software reference "file number" is equal to zero. It is to be noted that a "file number" of zero is not recognized as a valid file assignment. In this regard, the central processor pursues a "YES" path out of step 270 to common conjunction A in FIG. 4A. This will require the operator to again initiate communication with the automatic sewing machine system. This communication cannot result in an ultimate selection of a displayed pattern file number equal to zero.

Figure 4E:
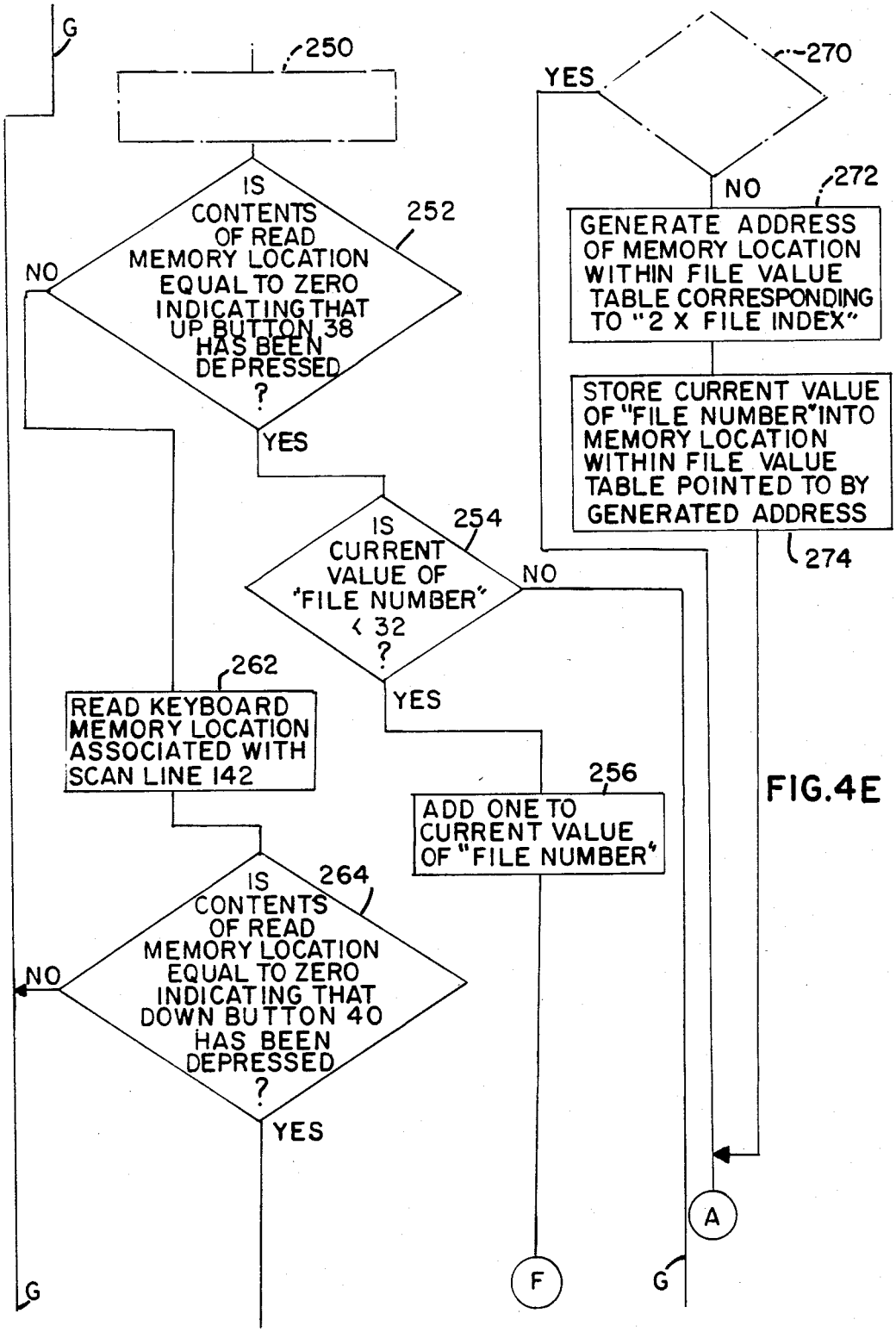
Figure 4F:
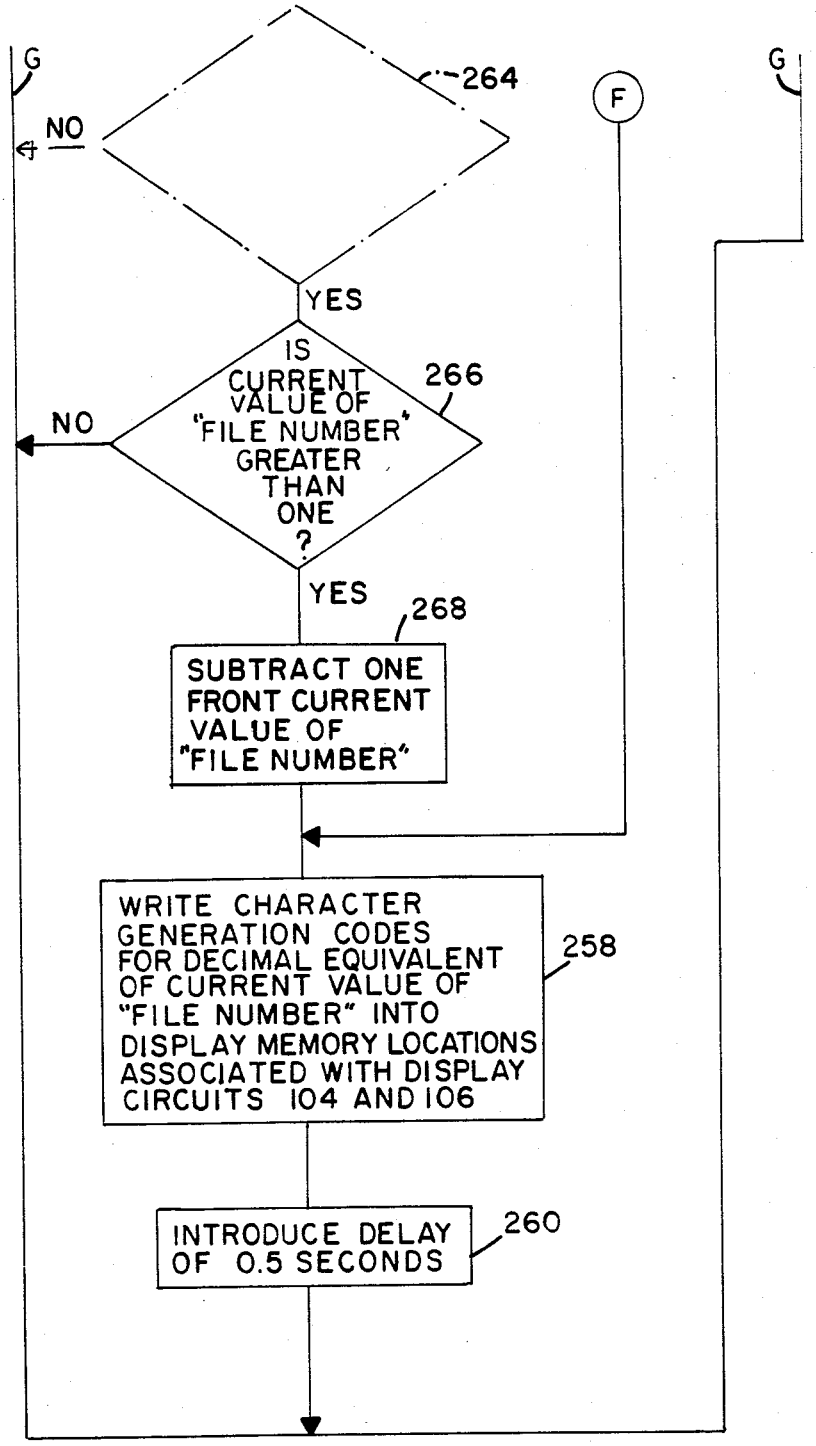

Referring again to step 270, it is seen that if the current value of the software reference "file number" is other than zero, the central processor proceeds along the "NO" path to a step 272. The central processor now generates an address of a memory location within the "file value" table corresponding to "2× file index". Referring to FIG. 5, the "file value" table is illustrated in detail. It will be remembered that the addressable memory locations within the "file value" table corresponding to twice the "file index" are the first addressable storage location within each pair of storage locations for a particular pattern selection switch. In this regard, each of the thus addressable storage locations initially are set at zero. The contents of the thus addressed memory location are changed to the current value of the software reference "file number" in a step 274. It is hence to be appreciated that any further addressing of this particular memory location within the "file value" table will result in a reading of the thus stored value of the "file number". Referring to FIG. 4E, the central processor proceeds from the step 274 back to the common junction A in FIG. 4A. Referring to FIG. 4A, it is noted that the central processor will proceed through the steps 204 and 206 so as to check for the "start" button 42 being depressed. This will constitute the communication from the operator that the displayed pattern file number is to be executed by the automatic sewing machine. This is in fact accomplished by the central processor proceeding along a "YES" path from step 206 to a step 276. In this regard, step 276 is an exit from the pattern selection program of FIGS. 4A through 4F. The exiting is to a program which ultimately accesses pattern data from the pattern memory 50. The pattern data which is accessed from the pattern memory is identified by the value of the software reference "file number" which the pattern selection program has provided. This is accomplished by an addressing technique premised on the numerical value of the "file number" which has been provided. It is to be noted that addressing techniques for accessing previously numbered stitch pattern files within randomly addressable memory is well known in the art. In accordance with the invention, the automatic sewing machine will return to the pattern selection program via the path 278. The pattern selection program will now look for a further communication from the operator relative to the next stitch pattern that is to be selected and thereafter sewn.

The central processor will look for the communication from the operator in steps 208, 210 and 216 through 232. In this regard, the central processor will be looking for the depression of a pattern selection button. The particular pattern selection button which is depressed, will result in a setting of the software reference "file index". The setting of the "file index" will allow the central processor to address and read a particular memory location within the "file value" table in steps 214 and 234. In the event that the addressed memory location within the "file value" table is other than zero, the central processor will proceed along a "NO" path to a step 280. It is to be noted that this will be the case when the various addressable memory locations within the "file value" table have been loaded with particular "file values". It will be remembered that the loading of a particular "file value" into a memory location occurs in step 274 following the procedure of selecting a particular "file value". Referring now to step 280, it is seen that the software reference "file number" is set equal to the contents of the addressed memory location containing a previously assigned "file value". The central processor will proceed to write the character generation codes for the word "FILE" into the display memory locations of the interface unit 48 associated with display circuits 96, 98, 100 and 102. This will result in the various letters being displayed on the alpha numeric displays 18, 20, 22 and 24. The central processor will now proceed in a step 284 to write the character generation codes for the decimal equivalent of the value of the software reference "file number". These codes will be written into the display memory locations of the interface unit 48 for an immediate further processing by the display circuits 104 and 106. This will result in an almost instantaneous display of the numerical designation of the stitch pattern on the alpha numeric displays 26 and 28.

The central processor will now introduce a delay of one half second in a step 286. This will allow the operator of the sewing machine time to react to the displayed number. The central processor will now inquire as to whether the previously depressed pattern selection button remains depressed in steps 242 through 248. In the event that the operator agrees with the displayed numerical designation, the pattern selection button will no longer be depressed. This will result in the central processor pursuing the "NO" path out of step 248 and hence through steps 270, 272 and 274 wherein the already read file number will again be stored in the appropriate memory location within the "file value" table. The central processor will now proceed to junction F and await a start authorization in steps 204 and 206. When this occurs, the "YES" path will be pursued to step 276 wherein the stitch pattern data will be accessed from the pattern memory 50.

It is to be appreciated that the operator of the automatic sewing machine may elect to change the displayed pattern file number which has been previously assigned to the particular depressed pattern selection button. This is accomplished by continuing to depress the pattern selection button following the display of the previously selected pattern "file number" in step 284. This will result in the "YES" path being pursued out of step 248 so as to allow the central processor to respond to either the "up" button 38 or the "down" button 40. In this manner, the operator can change the value of the previously displayed pattern file number in steps 250 through 268.

It is to be appreciated that a preferred embodiment of a pattern selection system has been disclosed for an automatic sewing machine system. Portions of this pattern selection system may be changed without departing from the scope of the invention.

What is claimed is:

1. An automatic sewing machine having a number of predefined stitch patterns stored in a memory, and furthermore having a smaller number of pattern selection switches wherein each of said smaller number of pattern selection switches may be assigned one of said predefined stitch patterns stored in the memory, a system for assigning the predefined stitch patterns in a manner which allows any assigned, predefined stitch pattern to be recalled from memory by activating the pattern selection switch to which the stitch pattern has been assigned, said system comprising:

means for monitoring the status of each pattern selection switch;

means for displaying a message in response to a change in status of any of the pattern selection switches, the message providing a designation of one of the predefined stitch patterns stored in the memory in the event that a prior assignment of a predefined stitch pattern stored in the memory has been made to the particular pattern selection switch in which a change in status has occurred;

means for altering the displayed message so as to display the designation of a different one of said number of predefined stitch patterns stored in the memory; and means for storing the designation of the different predefined stitch pattern for subsequent recall upon further activation of the particular pattern selection switch.

2. The automatic sewing machine of claim 1 wherein said system further comprises:

means for recalling the stored designation of the predefined stitch pattern in response to the same type of change in status of the pattern selection switch whereby the stored designation is displayed on said display means.

3. The automatic sewing machine of claim 1 wherein said means for monitoring the status of each pattern pattern selection switch comprises:

means for selectively identifying each pattern selection switch;

means for measuring the conductive status of the selectively identified switch; and means for storing a binary status representative of the conductive status of the selectively identified switch.

4. The automatic sewing machine of claim 1 wherein said means for displaying a message in response to a change in the status of a pattern selection switch comprises:

means for accessing a stored designation of a predefined stitch pattern, the stored designation having been previously associated with the pattern selection switch; and means for visually displaying the designation of the predefined stitch pattern.

5. The automatic sewing machine of claim 4 wherein said means for accessing a stored designation of a predefined stitch pattern comprises:

means, responsive to a change in status of a pattern selection switch, for generating a tabular reference; and means, responsive to the generated tabular reference, for reading a predefined storage location which may contain the designation of a predefined stitch pattern.

6. The automatic sewing machine of claim 1 wherein said means for altering the displayed message comprises:

means for monitoring a first switch indicative of whether a displayed designation is to be incrementally increased; and means for monitoring a second switch indicative of whether a displayed designation is to be incrementally decreased.

7. The automatic sewing machine of claim 6 wherein said means for altering the displayed message comprises:

means for incrementing the displayed designation by one in response to a predefined status of the first switch;

means for monitoring the current status of the pattern selection switch previously detected as having a change in status;

means for storing the incremented and displayed designation in response to a further change in status of the monitored pattern selection switch.

8. A system for processing the selection of stitch patterns that are to be sewn by an automatic sewing machine having a plurality of pattern selection switches, said system comprising:

means for monitoring the pattern selection switches so as to detect a change in status of any of said switches;

means for accessing one of a plurality of storage locations corresponding to the pattern selection switches within a randomly addressable memory in response to the change in status of one of said switches;

means for displaying the contents of the accessed storage location; and means for monitoring the changed status of the pattern selection switch to ascertain whether any further change in status occurs.

9. The system of claim 8 wherein said sewing machine furthermore has at least one pattern directional selection switch and wherein said system further comprises:

means for monitoring the status of the pattern directional selection switch when no further change in the status of the one pattern selection switch occurs.

10. The system of claim 9 wherein said system further comprises:

means for incrementally changing the displayed contents in response to a predefined status of the pattern directional selection switch whereby said means for monitoring the changed status of the pattern selection switch is operative to ascertain whether any further change in status occurs.

11. The system of claim 10 further comprising:

means for storing the displayed contents in the previously accessed storage location in response to said means for monitoring the changed status of the pattern selection switch being operative to note a further change in status.

12. The system of claim 8 wherein said means for accessing one of a plurality of storage locations within a randomly addressable memory comprises:

means for generating an address of a storage location having a predetermined relationship with respect to the switch with the changed status.

13. The system of claim 8 wherein the addresses of each of the plurality of storage locations have a predetermined relationship with respect to the plurality of pattern selection switches and said means for accessing one storage location comprises:

means for generating an address of a storage location utilizing the predetermined relationship; and means for addressing the storage location and reading the contents of the thus addressed storage location.

14. The system of claim 13 wherein said means for generating an address of a storage location comprises:

means for defining a different numerical identification for each pattern selection switch; and means for adding a multiple of the numerical identification for each pattern selection switch to a base address of a storage location having contents associated with a first numerically identified pattern selection switch.

* * * * *